US005487193A

United States Patent [19]

Hennessy

[11] Patent Number: 5,487,193

[45] Date of Patent: Jan. 30, 1996

[54] ENHANCED OPERATION TOILET

[75] Inventor: Arnold Hennessy, Wellington, Canada

[73] Assignee: Fluidmaster, Inc., Anaheim, Calif.

[21] Appl. No.: 113,387

[22] Filed: Aug. 27, 1993

Related U.S. Application Data

[63] Continuation-in-part of Ser. No. 870,569, Apr. 17, 1992, abandoned.

[51] Int. Cl.[6] ..... E03D 3/10

[52] U.S. Cl. ..... 4/328; 4/354; 4/362; 4/424; 222/341

[58] Field of Search ..... 4/328, 329, 332, 4/347, 354, 359, 361, 362, 424, 360, 364; 222/339, 341, 387

[56] References Cited

U.S. PATENT DOCUMENTS

| | | | |
|---|---|---|---|
| 2,793,793 | 5/1957 | Sampson | 4/354 X |
| 3,214,067 | 10/1965 | Linington | 222/341 |
| 3,344,960 | 10/1967 | Jacobs | 222/341 X |
| 4,115,883 | 9/1978 | Dauvergne | 4/362 X |

*Primary Examiner*—Robert M. Fetsuga

*Attorney, Agent, or Firm*—Freilich Hornbaker & Rosen

[57] ABSTRACT

A water saver toilet is provided, of the type that applies a vacuum to the toilet bowl outlet to assist flushing, which effectively uses the vacuum and which can be of low height. The toilet bowl outlet includes upper and lower trap devices (44, 50 in FIG. 2) connected by a trapway (46), with a vacuum source applied to the trapway during a flushing to pull out water and debris from the toilet bowl. One vacuum source (FIG. 3) includes a largely horizontal diaphragm (76) which separates a water chamber (82) from a vacuum chamber (80). The water chamber is initially filled with water, which is rapidly emptied during flushing, causing the diaphragm to rapidly fall from an upwardly bowed configuration (76) to a downwardly bowed configuration (76A). The vertically moving diaphragm produces a vacuum in the vacuum chamber that is connected to the trapway. A spring (84) (or weight) allows the water chamber to deliver water at a considerable pressure, regardless of the level of the water chamber with respect to the toilet bowl. Another vacuum source (FIG. 7) includes a water powered actuator (158) that receives water from a pressured water pipe at the beginning of flushing, to rapidly raise a vacuum diaphragm (170) that produces a vacuum in a vacuum chamber (172) which is connected to the trapway.

3 Claims, 3 Drawing Sheets

FIG. 3
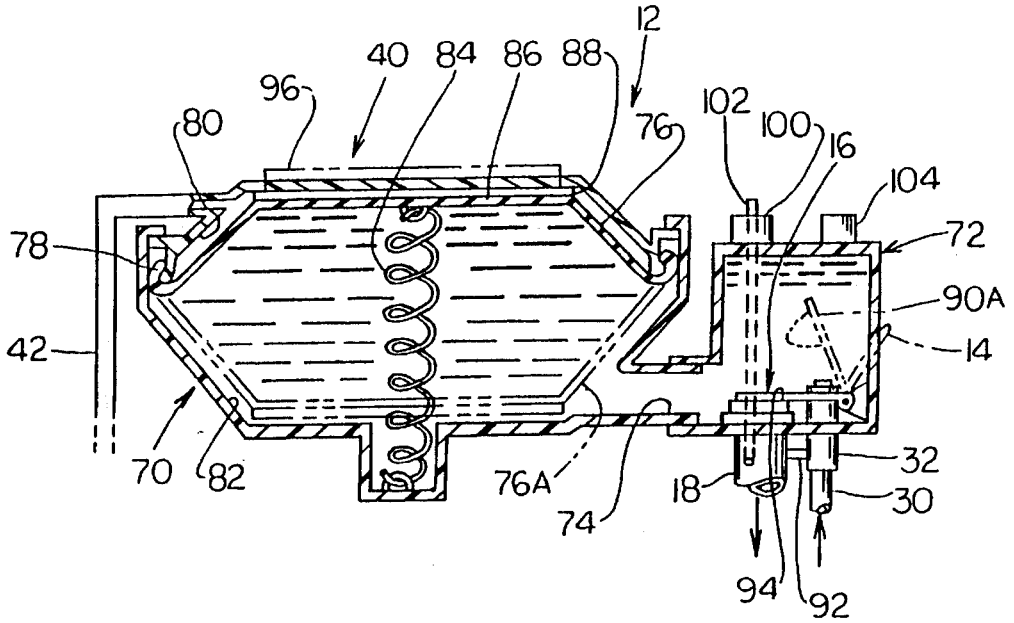
FIG. 5
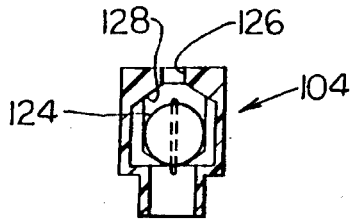
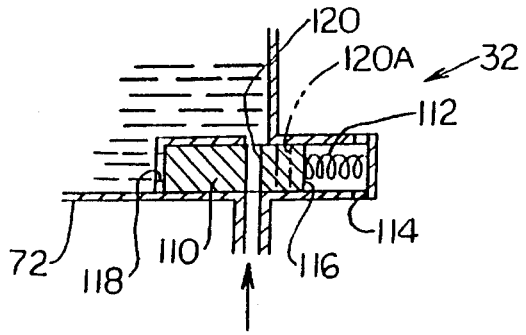
FIG. 4
FIG. 8
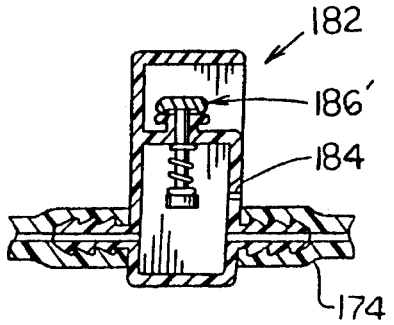
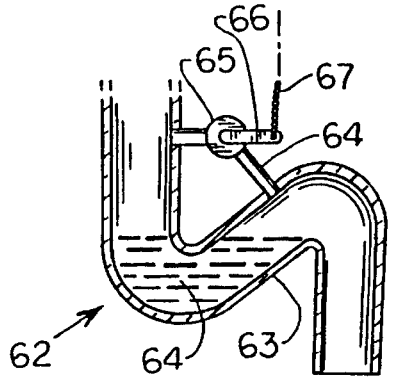
FIG. 2A

ENHANCED OPERATION TOILET

CROSS-REFERENCE TO RELATED CASES

This is a Continuation-in-Part of U.S. Ser. No. 07/870,569, filed Apr. 17, 1992, abandoned.

BACKGROUND OF THE INVENTION

Many cities are attempting to conserve water by reducing the amount used in each toilet flushing. One approach, described in U.S. Pat. No. 380,854 by Boyle, issued Apr. 10, 1888, is to apply a vacuum to the toilet bowl outlet near the beginning of each flushing to suck out water and debris to flow into a drain pipe. The water and vacuum source lie a considerable distance above the toilet bowl. It would be valuable if such toilet could operate with a water and vacuum source that could lie at a range of levels instead of only high above the level of the toilet bowl.

SUMMARY OF THE INVENTION

In accordance with one embodiment of the present invention, a vacuum assisted toilet is provided which is highly effective and reliable. The toilet includes a bowl outlet with a pair of trap devices and a trapway between them to which a vacuum is applied during flushing. In one toilet, a container apparatus is provided which holds most of the flushing water, which includes a movable divider device such as a diaphragm or bellows sealed to the walls of a container and moveable therein. The divider device divides the container into a vacuum chamber forming the vacuum source and a water chamber. The water chamber is initially filled with most of the flush water before flushing. At the beginning of flushing, water rapidly flows out of the water chamber into the toilet bowl, allowing the divider device to rapidly contract the water chamber and consequently expand the vacuum chamber to produce a vacuum therein that is coupled to the trapway. A biasing device such as a spring or weight moves the diaphragm device as the water chamber empties. The biasing device can apply a considerable pressure to the water in the water chamber, so the water chamber can lie even below the level of the toilet bowl.

Another vacuum source includes a movable divider device that can expand and contract the volume of a vacuum chamber, with the divider device being moved by a water powered actuator. The actuator, which is initially empty of water, is coupled through an inlet valve to a pressured household water supply at the beginning of flushing. The pressured water rapidly moves the actuator to expand the vacuum chamber and apply a vacuum to the toilet bowl outlet. Water in the water powered actuator can slowly drain out after each flushing.

The novel features of the invention are set forth with particularity in the appended claims. The invention will be best understood from the following description when read in conjunction with the accompanying drawings.

BRIEF DESCRIPTION OF THE DRAWINGS

FIG. 2A is a sectional side view of a lower trapway device constructed in accordance with another embodiment of the invention, which can be used with the toilet of FIG. 1.

FIG. 3 is a partial sectional view of the toilet of FIG. 1, showing the container apparatus thereof.

FIG. 4 is a simplified sectional view of an inlet valve that can be used with the apparatus of FIG. 3.

FIG. 5 is a sectional view of an air relief valve that can be used with the apparatus of FIG. 3.

FIG. 8 is a sectional view of a refill device of the toilet of FIG. 6.

DESCRIPTION OF THE PREFERRED EMBODIMENTS

Figure 1:
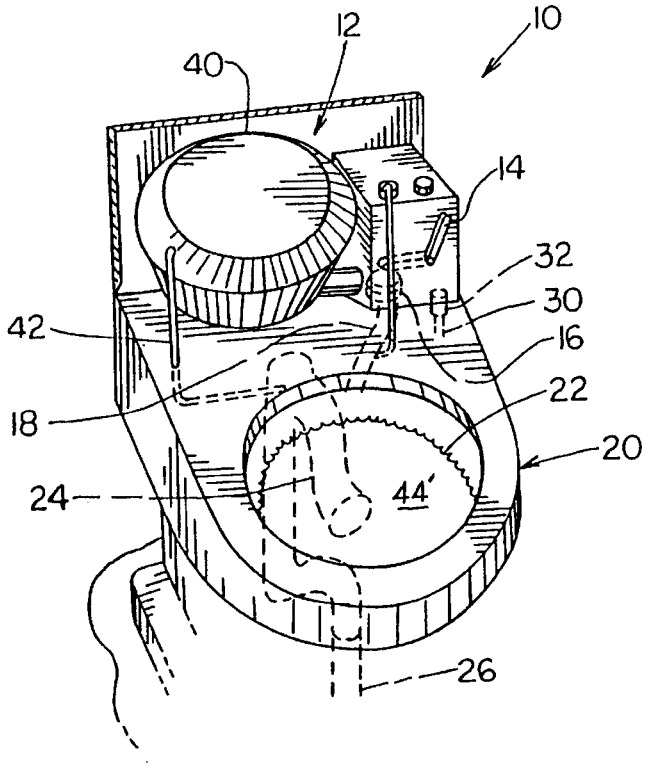
FIG. 1 is a partial sectional isometric view showing a vacuum assist toilet constructed in accordance with one embodiment of the present invention.

FIG. 1 illustrates a low profile toilet 10 which includes a container apparatus 12 that contains flush water. A person can move a lever 14 to open a flush valve 16 that allows water stored in the container apparatus to move through a flush conduit 18 into a toilet bowl 20. Water flushed into the toilet bowl raises the water level from an initial level 22, to cause water and any debris in the toilet bowl to flow out of a toilet bowl outlet 24 that carries water and waste to a drain 26 that connects to a sewer system. During a flushing, water flows rapidly into the toilet bowl and water and debris moves out of it. During a period of perhaps forty-five seconds after a flushing, water from a household water supply 30 flows through an inlet valve 32, with most of the water flowing into the container apparatus 12 to refill it and ready it for the next flushing. Part of the inflowing water flows through the flush conduit 18 into the toilet bowl 20 to refill it to the initial level 22. In large titles, the pressure of water supply to the inlet valve 32 is always a plurality of psi (pounds per square inch) and is usually much more than 20 psi (1.4 bar).

The toilet 10 is a vacuum assisted type, wherein a vacuum from a vacuum source 40, which happens to be part of the container apparatus 12, is applied through a vacuum conduit 42 to the toilet bowl outlet 24 to apply a vacuum therein during flushing of the toilet. The vacuum draws water and waste from the water pool 44' in the toilet bowl to efficiently flush the toilet bowl.

Figure 2:
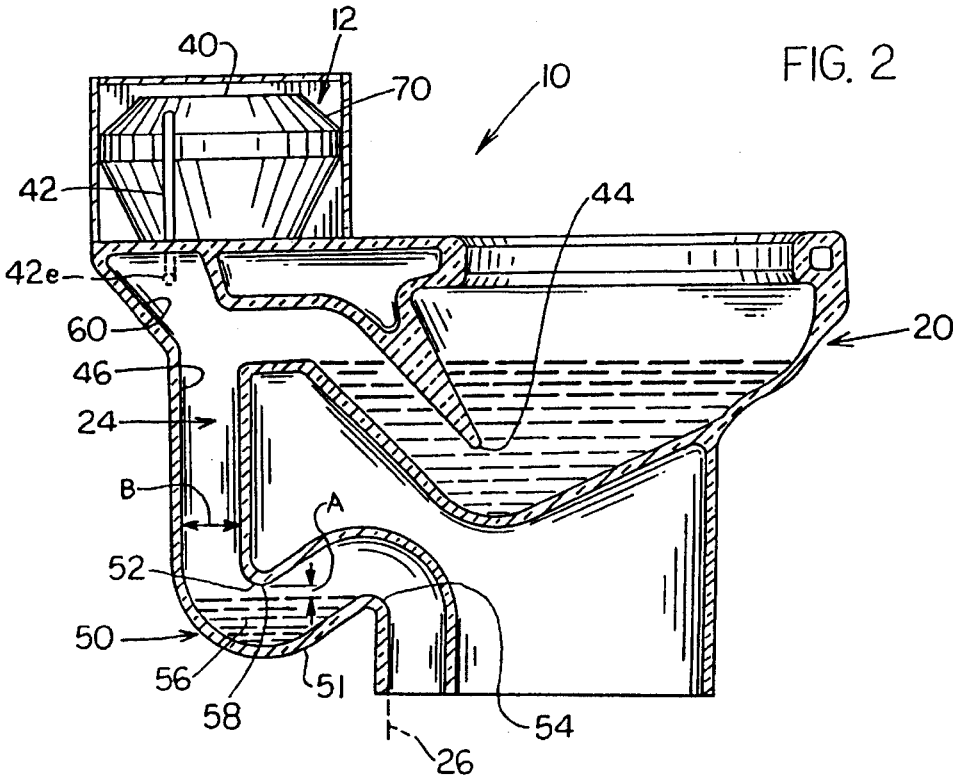
FIG. 2 is a sectional side view of the toilet of FIG. 1.

As shown in FIG. 2, the toilet bowl outlet 24 includes an upper trap device 44 coupled to the toilet bowl, and a trapway 46 extending from the upper trap device to a lower trap device 50 that leads to the drain 26. The lower trap device includes a conduit portion 51 extending at an upward incline in a downstream direction. The top 52 of the inside of the upstream end of the conduit portion lies slightly higher than the bottom 54 of the downstream end of the upwardly inclined conduit portion. The result is a lower trap pool 56, with the top of the pool lying a small distance A below the uppermost location 52. This leaves a trap region 58 that is initially open to allow gas to flow therethrough, which avoids siphoning out water from the toilet bowl between flushings. However, early during a flushing, water fills the lower trap device to above the location 52, which prevents a vacuum applied to the trapway 46, from being dissipated through the drain 26.

The distance A is preferably small, being less than half the width B of the trapway and of the conduit forming the lower trap 50. The traps and trapway generally have a considerable minimum width such as two inches (5 cm) to assure the reliable flow of debris therethrough. A small gap A such as one-half inch (1.3 cm) is desirable so that a vacuum can be established in the lower trapway near the very beginning of flushing, when water first flows out of the toilet bowl.

The end 42*e* of the vacuum conduit can be placed anywhere that it is in direct communication with the trapway 46. Applicant prefers to make the connection in a cavity 60 lying above the path of water flowing through the trapway to resist the entrance of water into the vacuum conduit.

FIG. 2A illustrates another lower trap device 62 which includes a conduit portion 63 extending at an upward incline (in a downstream direction) to a sufficient height to create a pool of water 64 that always blocks the flow of air. However, a bypass air conduit 64 connects locations on opposite sides of the water pool, through a valve 65 that is normally open. A valve actuator 66 is moved at substantially the beginning of a flushing, to temporarily close the valve and block air flow through it. The particular valve actuator 66 is moved by a chain 67 that is pulled when the flush lever 14 (FIG. 1) is moved. However, the valve actuator could be actuated by a vacuum applied along line 42, or by the inflow of water along pipe 30, or other event occurring within about one or two seconds after the beginning of a flushing. The valve 65 remains closed for a period such as six seconds after it is first closed. This period is long enough to avoid dissipating any vacuum applied, but is short enough to avoid syphoning out water from the toilet bowl as it is refilled.

FIG. 3 illustrates details of the container apparatus 12 and of the vacuum source 40 thereof. The container apparatus includes a large container 70 and a valve box 72, the two of them being connected by a large transfer opening 74. A dividing device 76 is provided which is in the form of a diaphragm with a periphery 78 sealed to the walls of the container to divide the container into a vacuum chamber 80 and a water chamber 82. Between flushings, the water chamber 82 is completely filled with water. A biasing device 84 in the form of a tension spring, tends to pull down the middle 86 of the diaphragm, which is rigidized by a plate 88. When the lever 14 is moved to pivot a flush valve member to the open position shown at 90A, the flush valve 16 is opened and water lying in the valve box 72 and in the water chamber 82 can move out of the flush conduit 18 to the toilet bowl to begin a flushing. As water flows rapidly out of the water chamber 82 and valve box 72 of the container apparatus, the diaphragm device 76 rapidly moves down to its down position shown at 76A. The spring biasing device 84 assures rapid downward movement of the diaphragm device, as well as creating a large pressure head, as will be described below. With the diaphragm rapidly moving down, the vacuum chamber 80 rapidly expands in volume, creating a vacuum therein which is coupled through vacuum conduit 42 to the trapway of the toilet bowl outlet. Thus, as water begins flowing into the toilet bowl to begin moving water and debris into the toilet bowl outlet, the vacuum source 40 applies a vacuum to the trapway of the toilet bowl outlet to enhance the movement of water and debris out of the toilet bowl towards the drain. The use of a vacuum to enhance flushing, reduces the amount of flush water required to effectively flush the toilet bowl.

It is noted that the diaphragm is bowed in opposite directions in configurations 76 and 76A (relative to a planar in between configuration). The spring 84 urges the diaphragm toward the bowed configuration 76A wherein substantially all water has been expelled from the water chamber.

Towards the end of the flushing, when the diaphragm device reaches its down position 76A, the pressure of water in the water chamber 82 and valve box 72 of the container apparatus decreases and the inlet valve 32 opens. Water then flows through the household water supply pipe 30, through the inlet valve 32 into the valve box 72 and into the water chamber 82 to refill it. As the water flows in through the inlet valve 32, the pressure of the inflowing water raises the diaphragm device back up to the position 76, so that any further inflow of water would greatly increase the pressure of water in the container apparatus. The inlet valve 32 then closes. While the inlet valve 32 is open, a portion of the water flowing through it flows through a refill pipe 92 and through the flush conduit 18 to a toilet bowl to refill the toilet bowl to its original level.

Applicant uses a spring biasing device 84 which maintains a pressure of water in the water chamber 82 at a pressure such as 1 psi (about 0.06 bar). Such a pressure of 1 psi provides the same pressure of water at the flush valve seat 94 as a tall water tank where the level of water is twenty seven inches (68 cm) above the flush valve seat. One advantage of such pressured water is that it allows the overall height of the toilet to be low. For the particular toilet illustrated in FIG. 2, the container 70 lies above the top of the toilet bowl but at only a low height. However, the pressure of the water results in the water flowing rapidly into the toilet bowl, which enhances the flushing of water and debris out of the toilet bowl. The rapid outflow of water also results in the diaphragm device 76 being rapidly lowered, to create a considerable vacuum early during the flushing. The large head produced by the pressure of 1 psi also enables the container apparatus 12 to lie at even a lower height, such as where the flush valve seat lies many inches below the top of the toilet bowl.

Although applicant prefers to use a spring for the biasing device, it is also possible to use a weight indicated at 96. However, if the overall diameter of the container 70 is about one foot (30 cm), then the weight would have to weigh about 113 pounds (51 kg) to produce a pressure of about 1 psi. Although applicant shows one tension spring, it is possible to use compression springs or leaf springs to press down the diaphragm device. Instead of a diaphragm, it is possible to use a bellows, piston, or other device as the diaphragm device, to movably divide the space between the water chamber and vacuum chamber. It may be noted that it is possible for the diaphragm device 76 to not extend horizontally, although a horizontal orientation is preferred to obtain symmetrical deformation of a flexible diaphragm device (diaphragm or bellows).

A small amount of biasing force can be applied by using an elastic diaphragm which is deformed from a flat shape by water pressure, as shown in U.S. Pat. No. 4,115,883 by Dauvergne. However, without a separate spring or weight biasing force, the force (and therefore water and vacuum pressure) that can be applied is limited, and rapidly decreases as the diaphragm approaches the flat shape. Also, such resilient diaphragms which are repeatedly stretched and relaxed, have a short lifetime. Applicant prefers to use a diaphragm which is not elastically stretched, or only slightly stretched, with most of the restoring force applied by a spring or weight.

The valve box 72 contains additional valves, including a pressure relief valve 100 which is set to open at a predetermined pressure such as 2 psi (0.12 bar), to prevent destruction of the apparatus in the event that the inlet valve 32 remains open after the pressure of 1 psi is reached in the water chamber 82. When the pressure relief valve 100 opens, it allows water to flow up out of the valve box and through a tube 102 into the flush conduit 18 to flow water to the toilet bowl. An air escape valve 104 is also provided, which allows any air to escape, while preventing the escape of water.

FIG. 4 is a simplified illustration of an inlet valve 32 which allows water to enter the valve box 72 until a pressure of 1 psi is reached, and which then closes. The inlet valve 32 includes a sliding valve member 110 which is urged towards the open position by a spring 112. Air openings 114 allow ambient air pressure to be applied to one end 116 of the valve member. The pressure of water in the valve box 72 is applied to the opposite end 118 of the valve member. When the pressure of water in the valve box reaches 1 psi, the pressure on the valve member end 118 is great enough to overcome the force of the spring 116, to move an opening 120 in the valve member to a position 120A at which the valve is closed. The valve member 110 can operate another valve (not shown) that supplies refill water to the toilet bowl. Of course, a wide variety of valve constructions are known for closing a valve when a predetermined water pressure is reached in the container.

FIG. 5 illustrates one example of an air escape valve 104. The valve 104 includes a light weight ball 124 which tends to remain in the down position shown, to allow air to flow around the ball and out through an outlet 126. However, when water rises to the level of the ball, the ball floats on the water, and rises until the ball presses against a surface 128, which closes the valve and prevents the outflow of water.

Figure 6:
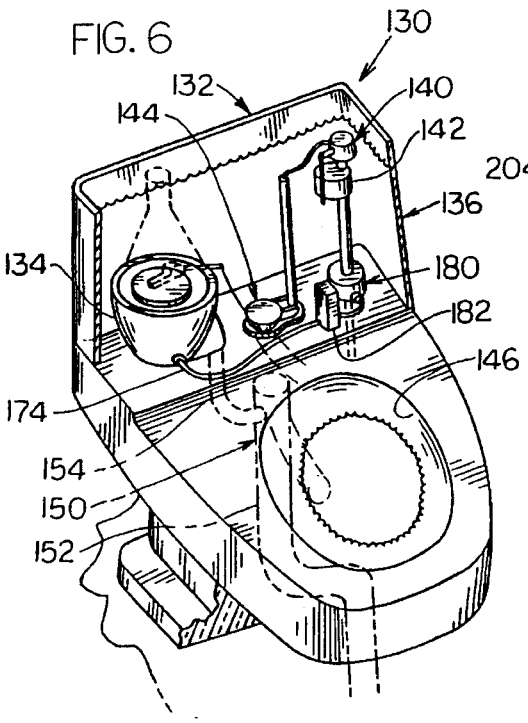
FIG. 6 is a partial sectional isometric view of a toilet constructed in accordance with another embodiment of the invention.

FIG. 6 illustrates another toilet 130 which employs a different container apparatus 132 and vacuum source 134. The container apparatus includes a water tank 136 of conventional but low profile construction. A conventional toilet inlet valve 140 is provided of the type that includes a float 142. Immediately after a flush valve 144 is opened to start dumping water in the tank into the toilet bowl 146, the float 142 falls and the inlet valve opens. The inlet valve then supplies pressured water through a pressured water conduit 174 to the vacuum source 134 to activate it, as will be discussed below. The toilet bowl outlet 150 is similar to that of FIG. 2, and includes upper and lower traps connected by a trapway 152 with a vacuum conduit 154 connected to the trapway to apply a vacuum thereto near the beginning of a flushing. The vacuum conduit 154 of FIG. 6 corresponds to the vacuum conduit 42 of FIG. 2, and the trapway 152 of FIG. 6 corresponds to the trapway 46 of FIG. 2.

Figure 7:
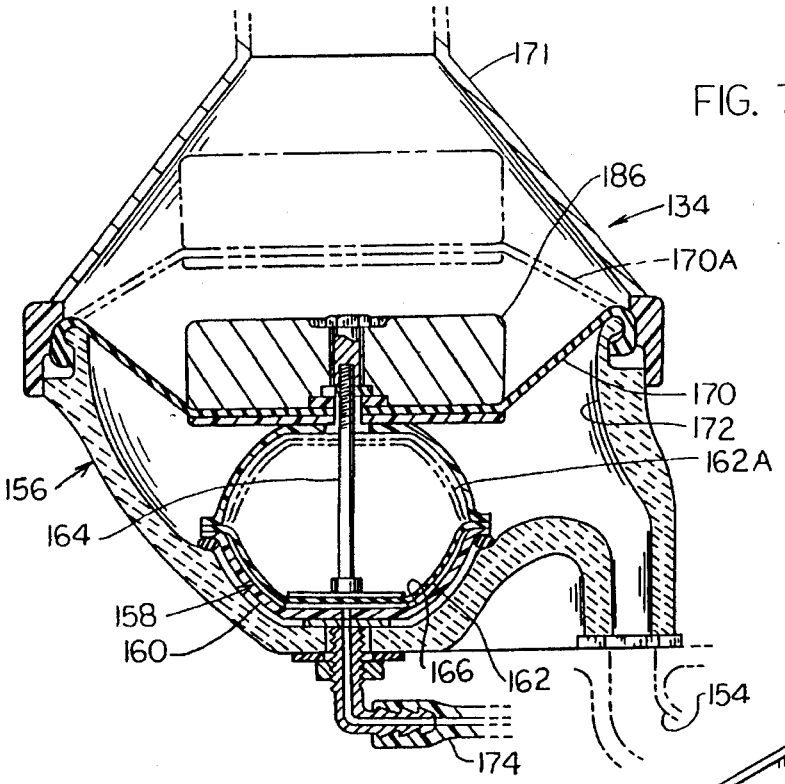
FIG. 7 is a sectional view of the vacuum source of the toilet of FIG. 6.

As shown in FIG. 7, the vacuum source 134 is connected to a pressured water conduit 174 and delivers a vacuum through the vacuum conduit 154 to the toilet bowl outlet. The vacuum source includes a housing 156 which contains a pressured-water powered actuator 158. The actuator includes a water vessel 160 and a water diaphragm 162 which extends across the vessel to form a water chamber 166 below the water diaphragm. A plunger 164 has a lower end attached to the middle of the water diaphragm and an upper end attached to the middle of a vacuum diaphragm 170. The vacuum diaphragm 170 seals the top of a vacuum chamber 172 formed largely by the housing 156. When pressured water passes through the pressured water conduit 174 (when flushing begins), the water presses upward against the water diaphragm 162 to raise it and the plunger 164, thereby raising the vacuum diaphragm 170 as to its upper position 170A. A chimney 171 extends above the water level in the tank. The rapid expansion of the vacuum chamber 172 results in the creation of a vacuum therein, which is communicated through the vacuum conduit 154 to the toilet bowl outlet.

After a flushing, and after the toilet bowl has been refilled and the inlet valve has closed, water in the water vessel 160 slowly flows out through the water conduit 174 to allow the vacuum diaphragm 170 to fall to its lower position to be ready for the next flushing. As discussed above, as soon as the flush valve 144 (FIG. 6) opens to start a flushing, water drops in the tank and the inlet valve 140 opens, and flows pressured water through the conduit 174 to the vacuum source 134 to activate it. After the tank 136 and toilet bowl 146 are refilled, water flows out of the vacuum source 134 through conduit 174 and through a tank refill device 182 into the tank 136.

The tank refill device, shown in FIG. 8, is connected in series with the pressured water conduit 174, and has a leak opening 184 that allows water to leak slowly into the tank. The vacuum source includes a weight 186 (FIG. 7) which presses down the vacuum diaphragm 170, and through the plunger 164 presses down the water diaphragm 162 to supply pressure to water in the water chamber 166 (a spring can be used). The pressured water passing out through water conduit 174, slowly leaks out of the leak opening of the tank refill device, so that after perhaps thirty seconds the diaphragms 170, 162 will move down to their lower positions. The water chamber 166 holds less than ten percent of the flush water held in the tank 136 (FIG. 6), so the water chamber 166 rapidly fills, and can empty through leakage in a moderate time period. The tank refill device 182 (FIG. 8) includes a valve 186' which opens at a predetermined pressure such as 8 psi to allow a rapid outflow of water from the conduit 174 into the tank after the vacuum source is activated. The valve 186 prevents the buildup of a pressure of more than about 8 psi in the vacuum source, to prevent damage to the vacuum source. However, a pressure of about 8 psi will be applied to the vacuum source, so long as the water supply pressure is above 8 psi (which is almost always the case) to assure rapid operation of the vacuum source near the beginning of flushing.

Figure 9:
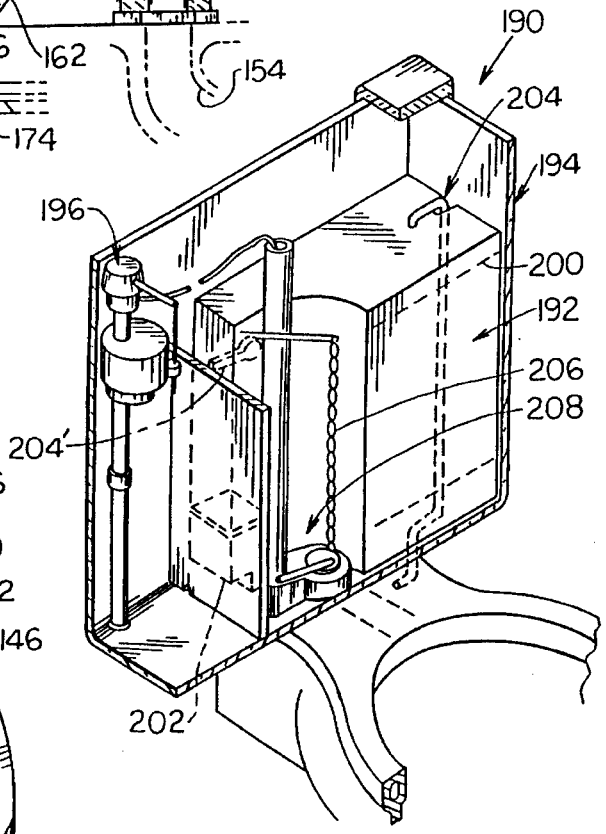
FIG. 9 is a partial sectional isometric view of a toilet constructed in accordance with another embodiment of the invention.

FIG. 9 illustrates another toilet 190 which is similar in many ways to conventional toilets with tall water tanks. The toilet 190 includes a plastic container 192 which lies within a water tank 194. When an inlet valve 196 opens after a flushing operation, water in the tank rises to a level indicated at 200. Water in the tank enters the container 192 through an opening 202 near the bottom of the container to fill the container to the level 200. Air in the container passes out through the top of the container and downwardly through a vacuum conduit 204 to a bowl outlet of the construction shown at 24 in FIG. 2. In FIG. 9, with the tank 194 and container 192 filled to a level 200, a lever 204' may be depressed to begin the flush cycle. Depressing the lever 204' lifts a chain 206 to open a flush valve 208 and pass water from the tank into the toilet bowl. Water in the plastic container 192 passes out through the opening 202 to flow out through the open flush valve 208. As the level of water in the container 192 drops, a vacuum is produced in the top of the container, which is transmitted through the vacuum conduit 204 to the trapway. The vacuum conduit 204 of FIG. 9 corresponds to the vacuum conduit 42 of FIG. 2, and the vacuum conduit 204 connects to a trapway similar to that shown at 46 in FIG. 2.

Thus, the invention provides a vacuum assist toilet which is reliable and yet which can reduce the amount of water required in a flushing. The toilet includes a toilet bowl outlet with upper and lower trap devices connected by a trapway, with the toilet applying a vacuum to the trapway at the beginning of a toilet bowl flushing. The lower trap device has a top that is unobstructed to the flow of gas therethrough when no water is flowing through the trapway, but which is sealed to the flow of gas when water begins flowing out of the toilet bowl early during flushing. This contains the vacuum in the trapway instead of dissipating it to the drain, and avoids later siphoning off of all water in the toilet bowl. One vacuum source includes a diaphragm which divides a container into vacuum and water chambers, with the water chamber being completely filled before a flushing and containing at least fifty per cent of the water dumped into the toilet bowl during a flushing (which does not include refill water that refills the toilet bowl after water and debris passes out of the bowl). A biasing device in the form of a spring or weight, biases the diaphragm to pressurize the stored water, to rapidly expel the water and rapidly create a vacuum applied to the toilet bowl outlet. The provision of a large volume container which holds water under a substantial pressure (e.g. 1 psi) is useful even in a non-vacuum assisted toilet, to provide flush water from a source that can lie at a low level (even below the top of the toilet bowl) and/or to provide a source of flushing water that empties the water vigorously into the toilet bowl. Another vacuum source includes a diaphragm which is rapidly moved by a pressured water powered actuator into which water rapidly flows at the beginning of a flushing, when an inlet valve opens.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A vacuum assisted toilet which includes a toilet bowl, a flush conduit for passing water to said bowl, a bowl outlet which is coupled to a drain, a source of flush water and vacuum, and a flush valve, wherein said source of flush water and vacuum includes walls forming a container and a dividing device within said container which divides it into a water chamber and a vacuum chamber, said flush valve being operable to flow water from said water chamber to said toilet bowl at the beginning of a flushing, said vacuum chamber being coupled to said bowl outlet to apply a vacuum thereto, said dividing device being movable to expand and contract said water chamber and respectively contract and expand said vacuum chamber, characterized by:

a spring coupled to said container and to said dividing device and urging said dividing device to contract said water chamber and expand said vacuum chamber, to cause water in said water chamber to flow rapidly into said toilet bowl and to produce a large vacuum in said vacuum chamber and therefore in said bowl outlet.

2. The toilet described in claim 1 wherein:

said water chamber and vacuum chamber are positioned so one of them lies below the other.

3. A toilet which includes a toilet bowl, a flush valve, a container apparatus which holds a quantity of water which passes out of said container apparatus and through said flush valve into said toilet bowl during a toilet flushing, an inlet valve which supplies water to said container apparatus, and a toilet bowl outlet which includes an upper trap device extending from said bowl, a trapway extending down from said upper trap device, and a lower trap device extending from said trapway to carry water and debris from said toilet bowl toward a drain, wherein said container apparatus includes a vacuum source coupled to said trapway, which applies a vacuum to said trapway in response to a toilet flushing, when water passes out of said container apparatus through said flush valve and said toilet bowl into said bowl outlet, characterized by:

said container apparatus includes walls forming a container, a diaphragm device with a periphery sealed to said container walls to divide said container into a vacuum chamber forming part of said vacuum source and a water chamber, said inlet valve being coupled to said water chamber to supply pressured water thereto that tends to move said diaphragm to expand said water chamber and contract said vacuum chamber while said inlet valve is open, and a spring which urges said diaphragm device to move to contract said water chamber and create a vacuum in said vacuum chamber when water passes out of said water chamber;

said container apparatus also includes a sealed valve box which is separated from said container and also includes walls forming a transfer opening that connects said water chamber to said valve box, said valve box including a flush valve seat opening coupled to said toilet bowl, a pressure relief valve, and an air escape valve;

said flush valve includes a flush valve member lying in said valve box, which moves against and away from said flush valve seat opening.

* * * * *